US005586498A

United States Patent [19]

Kikinis

[11] Patent Number: 5,586,498

[45] Date of Patent: Dec. 24, 1996

[54] DUPLICATE COPIES FROM A PRINTER OR COPIER

[75] Inventor: Dan Kikinis, Saratoga, Calif.

[73] Assignee: Elonex I.P. Holdings, Ltd., London, England

[21] Appl. No.: 548,848

[22] Filed: Oct. 26, 1995

Related U.S. Application Data

[62] Division of Ser. No. 291,987, Aug. 17, 1994.

[51] Int. Cl.[6] ..... B41M 1/12

[52] U.S. Cl. ..... 101/127; 101/128.21

[58] Field of Search ..... 101/129, 128.21, 101/127, 401.1; 400/497; 428/139, 138, 131, 137

[56] References Cited

U.S. PATENT DOCUMENTS

| | | | |
|---|---|---|---|
| 1,469,554 | 10/1923 | Crowder | 428/138 |
| 2,976,802 | 3/1958 | Mason | 101/128.1 |
| 3,289,579 | 3/1965 | Block | 101/473 |
| 4,088,073 | 5/1978 | Crystal et al. | 101/401.1 |
| 4,514,361 | 9/1986 | Foster | 282/8 |
| 4,726,972 | 2/1988 | Instance | 428/40 |
| 4,821,439 | 4/1989 | Wilck | 40/638 |
| 4,971,644 | 11/1990 | Mahn | 156/253 |
| 5,250,342 | 10/1993 | Lang et al. | 428/139 |

*Primary Examiner*—Edgar S. Burr
*Assistant Examiner*—Anthony H. Nguyen
*Attorney, Agent, or Firm*—Donald R. Boys

[57] ABSTRACT

A print-through form comprises a top and a base layer with the top layer having a pattern of openings in at least one region, the pattern of openings having center-to-center distances substantially less than the size of characters or other elements to be printed. Ink applied to the region or regions with openings forms characters on the top layer by marking the area between the openings, and on the base layer in the same operation through the openings, marking the area on the base layer exposed by the openings through the first layer. More than two copies in a single printing pass may be accomplished with forms of more than two layers, wherein the patterns of openings expose area on all the intermediate layers and the base layer. In various embodiments forms may comprise sheets affixed by peelable adhesive, by folding larger sheets, and by edge gluing with removable strips made by perforation lines. Some forms are made to be fed through traction feeders from continuous webs.

3 Claims, 9 Drawing Sheets

DUPLICATE COPIES FROM A PRINTER OR COPIER

CROSS-REFERENCE TO RELATED DOCUMENTS

The present invention is a division of copending application Ser. No. 08/291,987, incorporated herein by reference.

FIELD OF THE INVENTION

This invention relates in general to priming operations for providing hard-copy documents, and more particularly to methods, forms, and apparatus for providing multiple copies of a document in a single priming pass.

BACKGROUND OF THE INVENTION

In very general terms, the art of printing involves application of an opaque medium, often in a liquid or semi-liquid ink form, to a background material such as paper. The ink marks on the paper or other medium typically take the form of language characters (letters) and graphics (pictures).

Historically, and particularly before the relatively recent advent of computerized systems, printing has been accomplished on apparatus known generally as printing presses.

Most printing presses have some common features. For example, in most printing presses, raised type is used, ink is applied to the type faces in liquid or paste form, such as by rollers, and the actual printing is accomplished by bringing the inked typefaces into contact with the medium, such as paper. The ink is transferred in the process from the typefaces to the paper or other medium.

There have been developed over the years many types of printing presses. Some print on single sheets, rapidly and successively fed, and others use type set on rollers to print on continuous webs of paper. Newspapers have been typically printed by this technique.

Another common and well-known printing machine that has been around a long while is the typewriter. In typewriters, individual type heads are moved to strike an inked ribbon in near proximity to the paper or other medium upon which printing is desired. As each letter is printed, a mechanism moves the strike region to the next character space to be printed. Many ingenious mechanisms have been developed for typewriting.

With the advent of computers, many new developments have been made in printers. Typesetting for high-volume printing machines is now computerized. In the area of general-purpose personal computers, printers operated by such computers have become as common in modern offices as typewriters were in offices of times past.

There are a variety of types of printers used with personal computers. Some are similar in form to typewriters, such as dot matrix printers, which use a mechanism to strike a ribbon to transfer ink to paper. Others, known in the industry as ink-jet printers, spray ink from multiple tiny nozzles to provide characters and graphics on paper. Still others, called laser printers, use a laser to write characters and graphics on a drum, which then attracts ink in a fine powder form, which is transferred to paper and fused by heat to the paper. Laser printers have enjoyed enormous success.

A very common requirement in printing is making multiple copies. Forms like shipping labels, for example, often must be made in multiples, so different people responsible in a phase of the operation of transport may each have an exact copy of the original. Exact copies are reliably provided by carbon sheets between layers of paper, and by later print-through types of forms that mimic the familiar carbon-copy operation without the need for intermediate sheets.

There is a serious limitation, however, to the common print-through copy-making technique. The technique is severely limited to impact-type and pressure type printers, because the print-through requires pressure in the shape and form of the characters and graphics to be printed. Printers like ink jet and laser printers, that do not employ pressure devices, can't use the technique, and the only way to make multiple copies with these printers is by repetition. Repetition is slow and costly.

What is clearly needed is a way usable by all kinds of printers that apply ink to paper to make multiple copies in a single pass.

SUMMARY OF THE INVENTION

In a preferred embodiment a print-through form is provided for making duplicate copies in a single printing process. The form comprises a top layer having a multiplicity of openings therethrough in at least one region, the openings being on centers substantially less than the dimensions of characters and other elements to be printed. A base layer adjacent to and underlying the top layer has a multiplicity of areas exposed through the openings in the top layer, such that ink applied to the top layer marks the top layer in the areas between the openings, and the base layer on the areas exposed through the openings.

In alternative embodiments forms comprise an intermediate layer between the top layer and the base layer, the top and intermediate layer having a first pattern of openings from the top layer through to the base layer, exposing area on the base layer, and a second pattern of openings from the top layer through to the intermediate layer, exposing area on the intermediate layer. In yet other embodiments there is more than one intermediate layer, wherein combinations of the top and intermediate layers have patterns of openings exposing area on the base layer and on each of the intermediate layers.

In a minimum aspect, useful in many printers, a layer with openings may simply be aligned with a layer without openings. In other embodiments, layers may be secured with adhesives, either in selected areas or generally over the surface of the layers. In other embodiments forms are provided configured for feeding in continuous webs in tractor-type feed devices in printers.

There is a wide variety in the sizes of openings that may be used, and in the spacing of openings in areas where printing is to be done on a form. Generally speaking, the hole sizes and spacings are determined by the nature of the characters and graphic elements to be printed.

Forms according to various embodiments of the invention extend the facility of making multiple copies in a single pass to a much wider range of types of printers than was heretofore possible, including non-impact printers like ink jet and laser printers. Non-impact printers then become more useful for applications where multiple copies are required, such as in printing shipping labels and the like.

DESCRIPTION OF THE PREFERRED EMBODIMENTS

Figure 1:
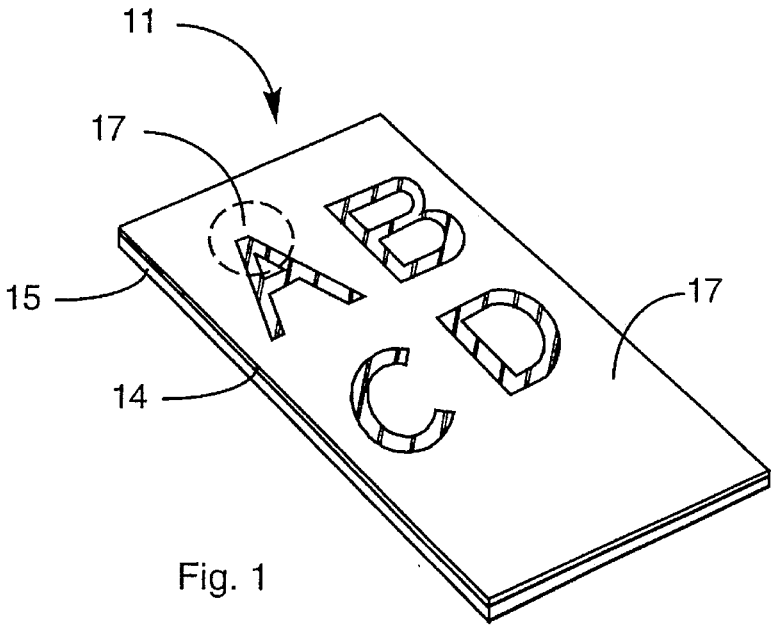
FIG. 1 is an isometric view of a form according to the invention for making two copies of a document in a single printing operation.

FIG. 1 is an isometric view of a form 11 according to the present invention for making two copies of a specific document in a single printing operation. Form 11 in this embodiment comprises two sheets of material 13 and 15, held in intimate proximity by a film of adhesive 14 in a manner to be separable by peeling one sheet from the other. The specific structure of the form by layers with adhesive is described in further detail below.

In the embodiment shown by FIG. 1, sheet 13 and sheet 15 have different characteristics. Sheet 13 forms an upper layer, and printing on the form is accomplished from the side of sheet 13. Sheet 15 is a lower sheet. In this example, four characters A, B, C, and D, are shown printed on form 11 to provide a basis for describing features of the present invention. The size of the letters shown, their form, their placement, or the fact that they are letters rather than other characters or graphic elements is not pertinent to the invention.

Figure 2:
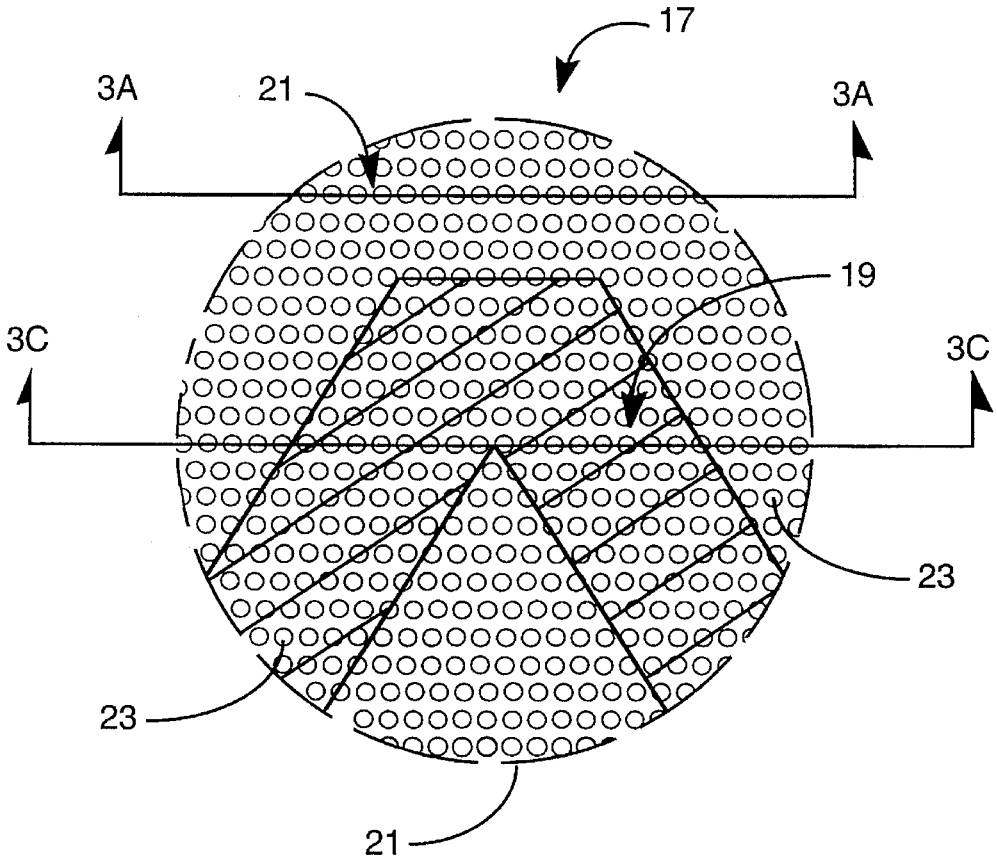
FIG. 2 is an enlargement of a specific exemplary region of the top surface of the form of FIG. 1.

FIG. 2 is an enlargement of region 17 of FIG. 1 on form 11, viewed directly from above, that is, orthogonal to the surface of sheet 13. This region shows only the upper portions of the printed letter "A" on form 11. For ease of description, the inked area shown in region 17 is given an element number 19, and element number 21 refers to the uninked area of region 17. Also for ease of description, inked area 19 is shown as cross-hatched rather than as a solid color, although in many printing operations, the ink would cover area 19 continuously. In some printing operations, inked area 19 would comprise a dense matrix of inked dots, as made by a dot matrix printer and the like.

Region 17 in FIG. 2 has a regular matrix of openings 23 over the entire surface. Only a few of the openings are labeled with the element number to avoid confusion. These openings, in fact, cover the entire area of sheet 13 of FIG. 1, however, in this embodiment of the invention the openings are too small and closely spaced to be shown in FIG. 1.

Figure 3A:
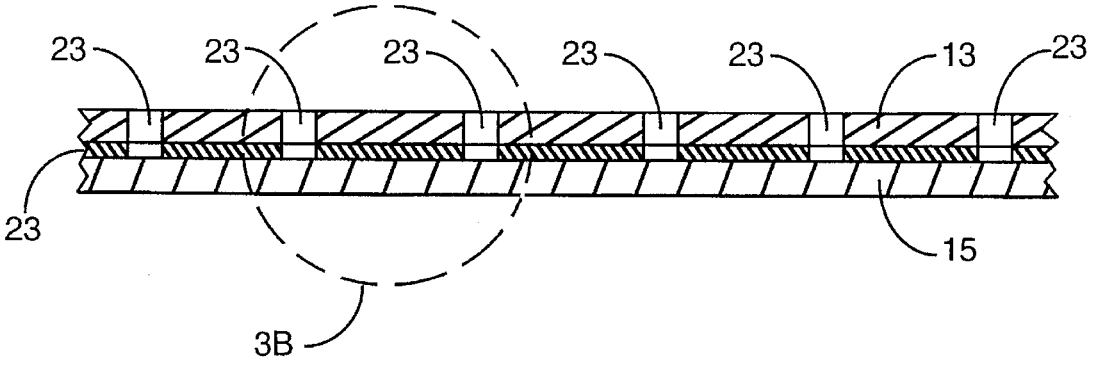
FIG. 3A is a cross section of the form of FIG. 2, taken along section line 3A—3A of FIG. 2.

FIG. 3A is a cross section through region 17 of form 11 along section line 3A—3A of FIG. 2, passing through a part of region 21 where no ink has been deposited. Upper sheet 13 and lower sheet 15 in this embodiment are affixed with adhesive film 14 between the sheets. The relative thicknesses of sheets 13 and 15, and of adhesive 14, have all been exaggerated for clarity.

Figure 3B:
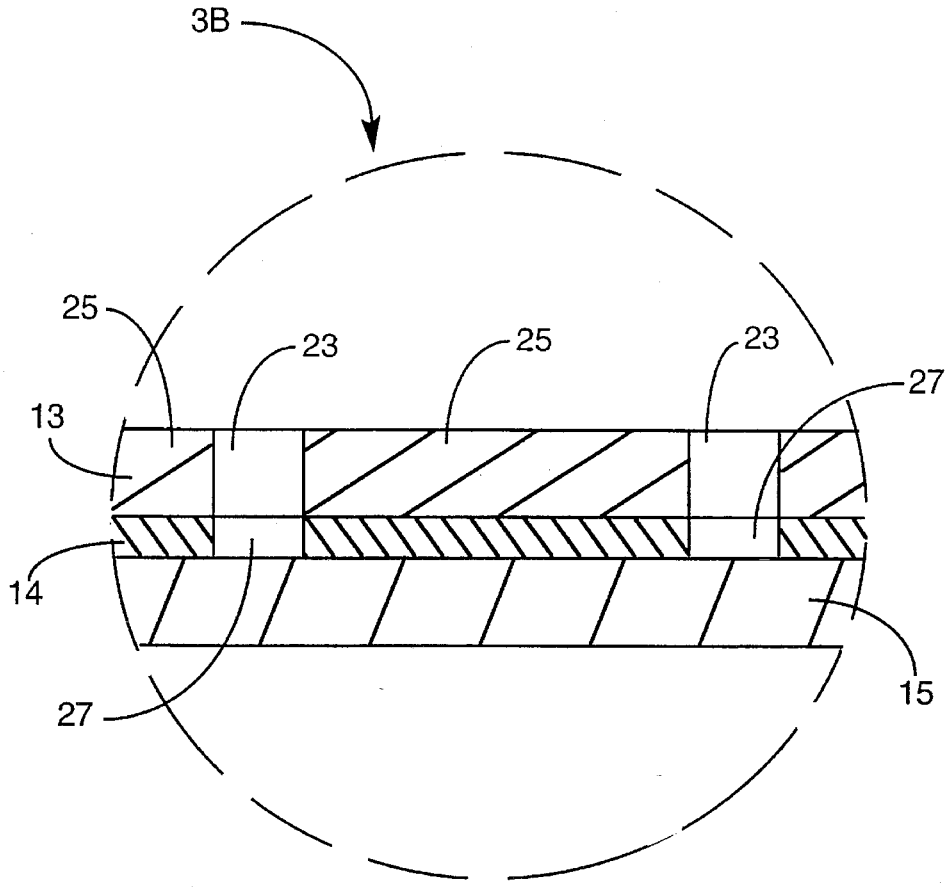
FIG. 3B is an enlarged portion of the cross-section of FIG. 3A.

FIG. 3B is an enlargement of the portion of the cross section of FIG. 3A shown in dotted circle 3B. Openings 23 pass through upper sheet 13 and adhesive film 14, and there are no such openings in lower sheet 15. The openings therefore present an exposed surface 25 on the upper sheet, and a plurality of exposed surfaces 27 on the lower sheet through the upper sheet, in the pattern of, and to the extent of the total area of, all of the openings 23. These surfaces 25 and 27 are presented to the side of form 11 from which printing is accomplished (ie. ink is applied).

Figure 3C:
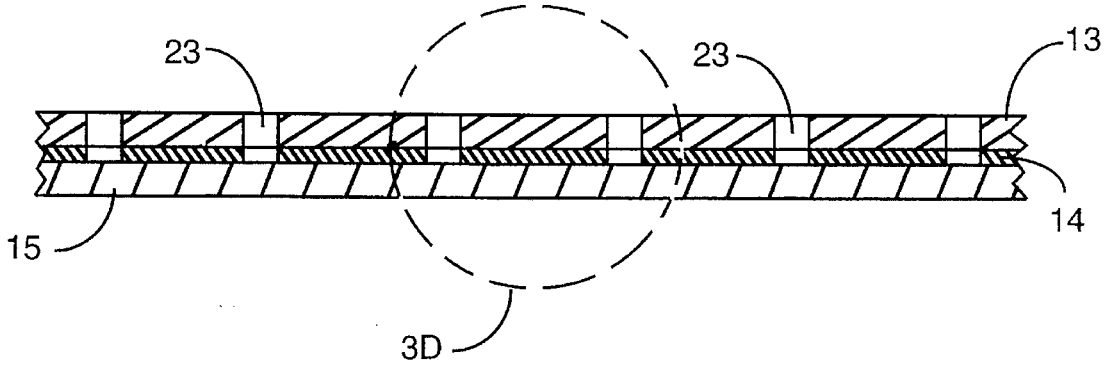
FIG. 3C is a section of the form of FIG. 3A taken along section line 3C—3C.
Figure 3D:
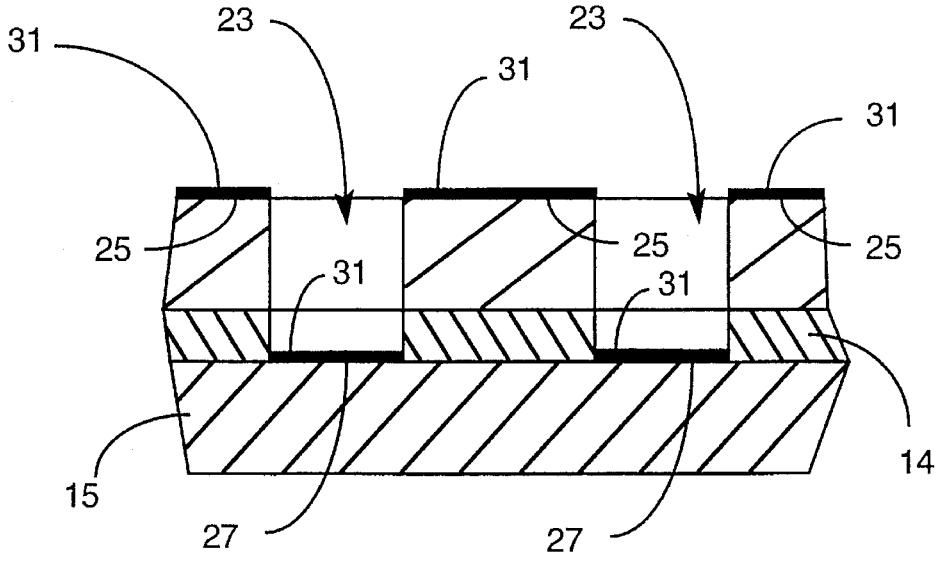
FIG. 3D is an enlargement of a region of the cross-section of FIG. 3C.

FIG. 3C is a cross-section through form 11 taken along section line 3C—3C of FIG. 2, passing through a portion of inked region 19, which is a portion of the printed letter "A". The structure and relationship of the sheets, adhesive, and openings is the same as for the cross-section of FIG. 3A. FIG. 3D is an enlargement of the region within dotted circle 3D of FIG. 3C, showing two openings 23 at a point where ink has been applied to form the inked region of the letter "A". Ink, indicated as 31, applied from the side of sheet 13 of form 11, not only covers surface 25, but also surfaces 27 of sheet 15 within the openings 23.

It will be apparent to those with skill in the printing arts that there are many ways the ink might be applied. It may be sprayed, as with an ink jet printer, applied by contact from an inked typeface, or applied in another manner. In any case, the inking operation will ink both surface 25 on sheet 13 and surfaces 27 on sheet 15.

Figure 4A:
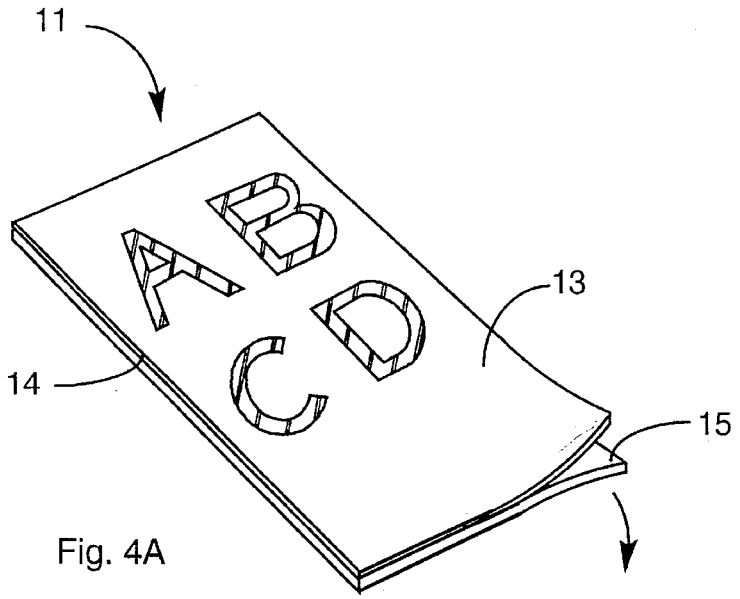
FIG. 4A is an isometric view of a form like the form of FIG. 1 with the process of separating the layers initiated.
Figure 4B:
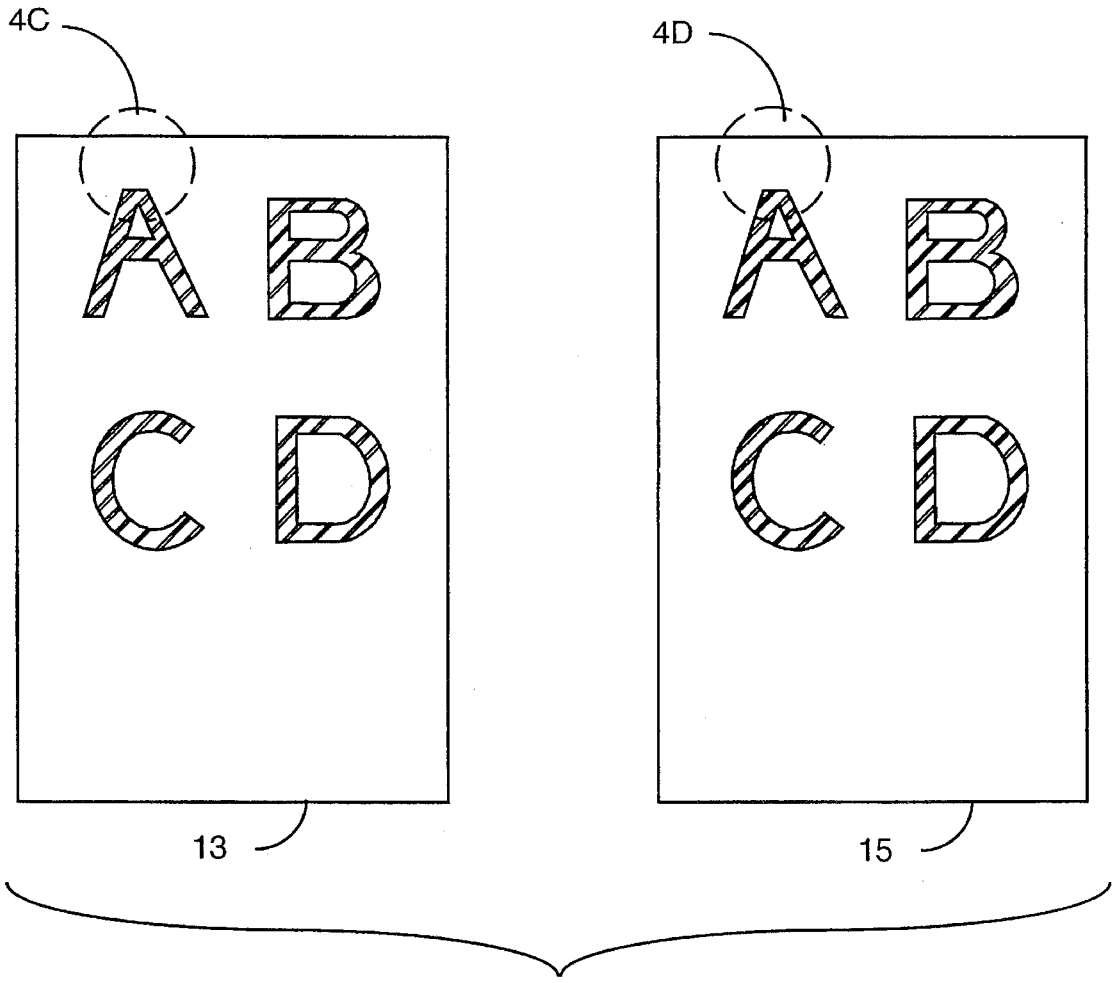
FIG. 4B shows the separated layers of the form of FIG. 4A, with the layers placed side-by-side.

FIG. 4A is an isometric view of form 11 similar to the view of FIG. 1, showing sheets 13 and 15 beginning to be separated at one corner. FIG. 4B shows sheets 11 and 13 peeled completely apart and placed side-by-side. The form of letters A,B, C, and D is evident on both sheets.

Figure 4C:
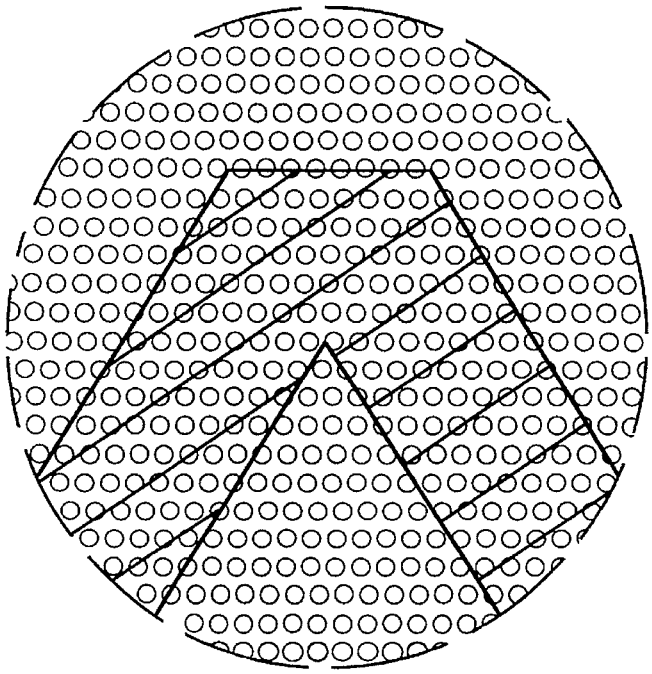
FIG. 4C is an enlargement of a portion of the top layer from FIG. 4B.
Figure 4D:
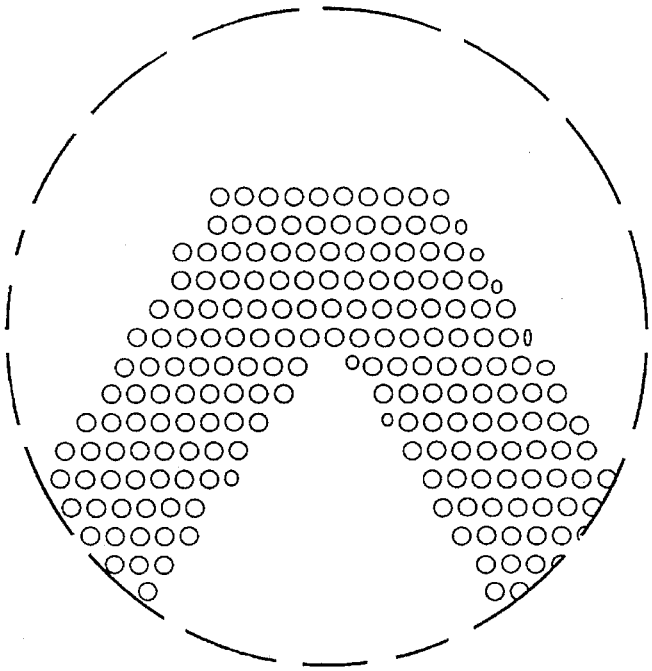
FIG. 4D is an enlargement of a portion of the base layer from FIG. 4B.

FIG. 4C is an enlargement of the region within dotted circle 4C of FIG. 4B, and FIG. 4D is an enlargement of the region within dotted circle 4D of FIG. 4B. The form of the upper portion of the letter "A" as seen in FIG. 4C is formed of the ink deposited on surface 25 (FIG. 3D), and the form of the upper portion of the letter "A" as seen in FIG. 4D is formed by the ink deposited on the surfaces 27 on sheet 15 (FIG. 3D).

It will be apparent to those with skill in the art that the clarity of the letter forms, and any other characters or graphic elements deposited on form 11, will be in part determined by the size of (dia.) and the spacing of openings 23. For typical font sizes for printing text, the hole spacing and diameter must be relatively small.

In one embodiment of the present invention, hole size a spacing is provided as a function of expected character size to be printed, to be able to exhibit readable characters on both of the sheets of the printing form. For example, assuming a character space of 3 mm×3 mm., which is a little less than ⅛ inch square, in this embodiment openings are provided in the upper sheet in a manner to have 100 openings in the character space (10×10 matrix), and of a diameter to expose to ink 50% of the area of the character space on each of the upper and the lower sheets.

Since the character space is 3 mm×3 mm., the area of the character space is 9 $mm^2$. Half of this area if 4.5 $mm^2$. The area of each hole of 100 openings for a character space would by 4.5/100, or 0.045 $mm^2$. The diameter of each hole is then 0.24 mm, and the spacing is about 0.3 mm. between openings in the hole matrix of the upper sheet.

In a preferred embodiment, the thickness of the upper sheet is intentionally considerably less than the thickness of the lower sheet, to facilitate ink migration down into the openings to color the lower sheet in a manner that the characters printed on both sheets will be recognizable on each form when the forms are separated.

Figure 5:
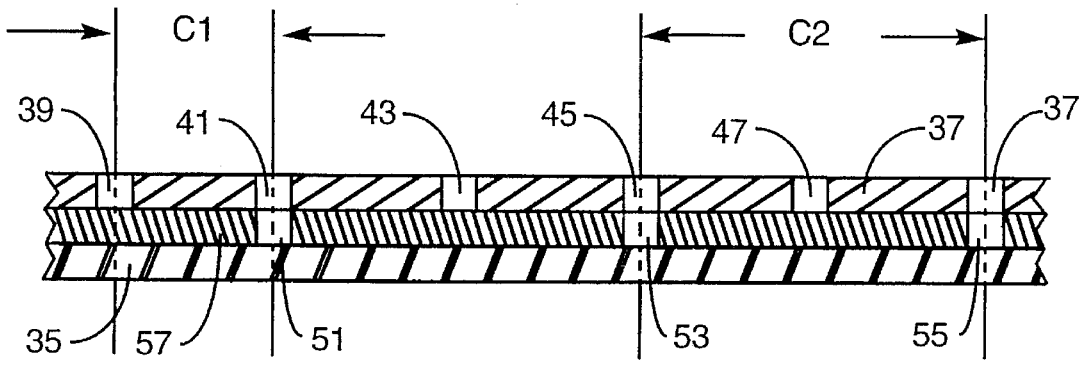
FIG. 5 is a cross-section of a three layer form in an embodiment of the invention.

In alternative embodiments of the present invention there may three or more sheets layered in a single form, with hole patterns in all of the upper sheets, but not in the lowest, or base sheet. FIG. 5 is a cross section through several of the openings of a three-layer form according to an alternative embodiment of the invention. Adhesive layers are not shown in this section. In this embodiment base layer 35 has no openings. Top layer 37 has a matrix of openings illustrated by openings 39–49 on centers of dimension C1. Intermediate layer 57 has a matrix of openings illustrated by openings 51, 53, and 55 on centers of dimension C2.

In the embodiment illustrated by FIG. 5, C2 is twice C1, the openings are all of the same diameter, and the matrix of openings in intermediate sheet 57 is aligned with the matrix of openings in upper sheet 37, such that all of the openings in sheet 57 align with half of the openings in sheet 37. In this arrangement openings 41 and 51 align, providing a path for ink to color area on base layer 35, as do openings 45 and 53, and openings 49 and 55. Openings 39, 43, and 47 allow ink to pass through layer 37 to color layer 57 with the same resolution that base layer 35 will be colored.

It will be apparent to those with skill in the art that the number of layers that may overlaid with hole matrices to provide legible printing on each of the sheets of the form is a function of such variables as the size of the characters printed, the thickness of the layers, and the diameter and spacing of openings through the various sheets that make up a printing form according to the invention.

In the embodiments described above, the openings through sheets of a form have been described and shown as round openings, and typically the openings have been shown and described as existing in a uniform matrix. In some alternative embodiments, the openings are not openings at all, and in others, the organization of openings is random rather than uniform.

Figure 6A:
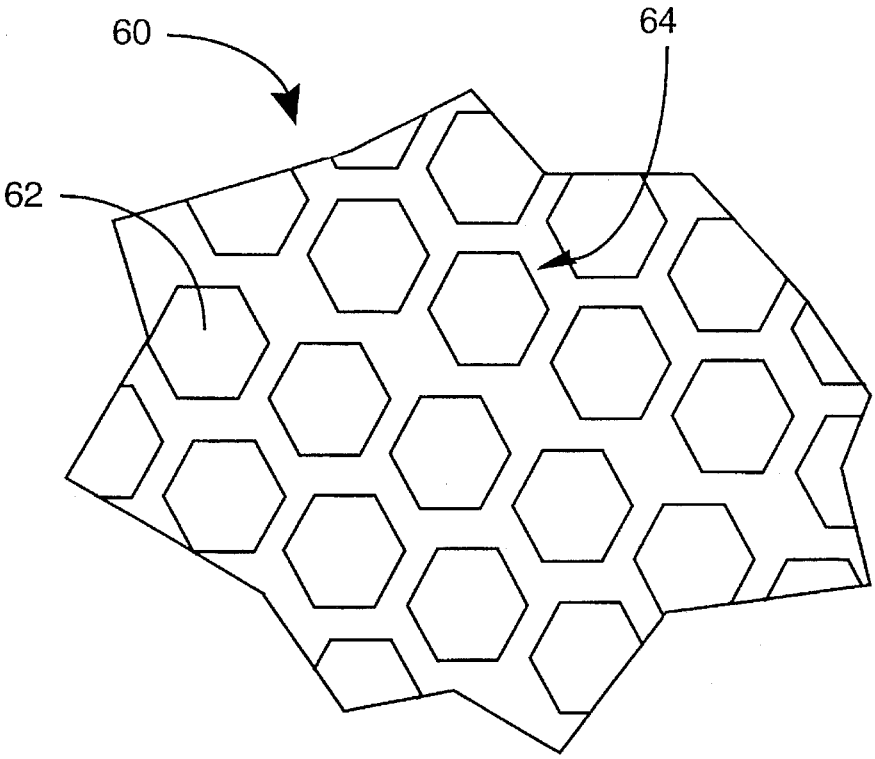
FIG. 6A is a plan view of a pattern of openings in an upper layer of a form according to an alternative embodiment of the present invention.

FIG. 6A shows a pattern of openings 62 in an upper layer of a form 60 in an alternative embodiment of the present invention. In this embodiment the openings are regular hexagons regularly spaced, so area 64 of the upper layer exposed to inking is a contiguous web of the spaces between the hexagonal openings. Forming the openings in a geometry such as the hexagons shown has an advantage of providing a balance of areas for printing between the layers. It will be apparent to those with skill in the art that there very many geometric shapes that might be employed, such as squares and trangles, as well as the hexagons shown and other polygons.

Figure 6B:
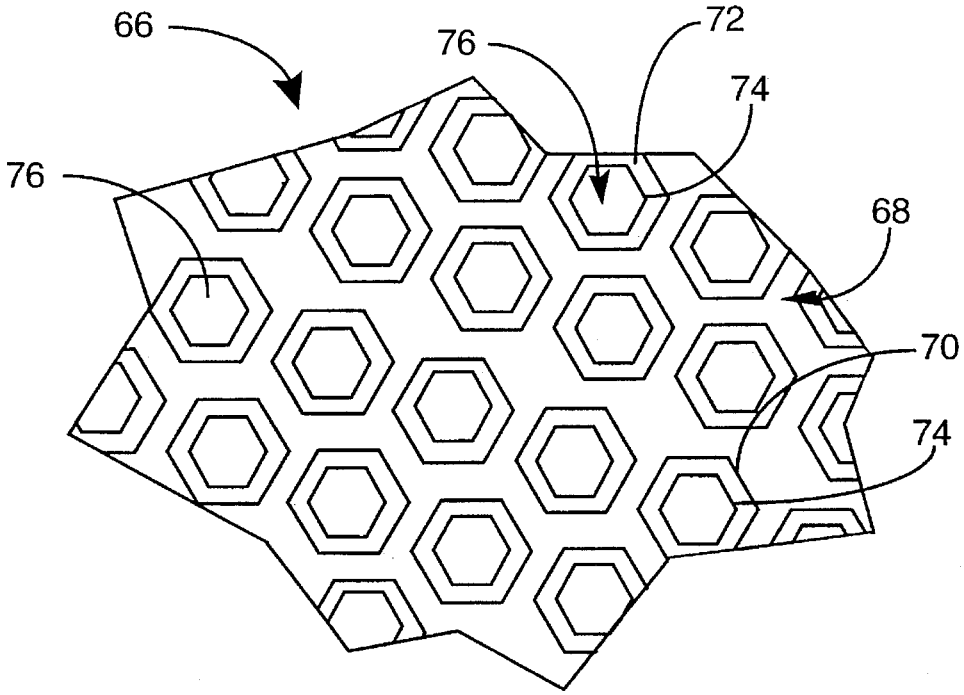
FIG. 6B is a plan view of a portion of a multi-layer form according to an alternative embodiment of the present invention.

FIG. 6B is a plan view showing a form 66 with another arrangement of openings wherein top layer 68 has substantially the hexagonal pattern of openings 70 that are employed for form 60 in FIG. 6A. In the embodiment shown by FIG. 6B, however, there is an intermediate layer and a bottom layer. Intermediate layer 72 has a pattern of holes 74 exposing hexagonal areas on bottom layer 76. In this manner, ink applied to form 66 from the side of layer 68 marks areas on intermediate layer 72 and bottom layer 76.

Figure 6C:
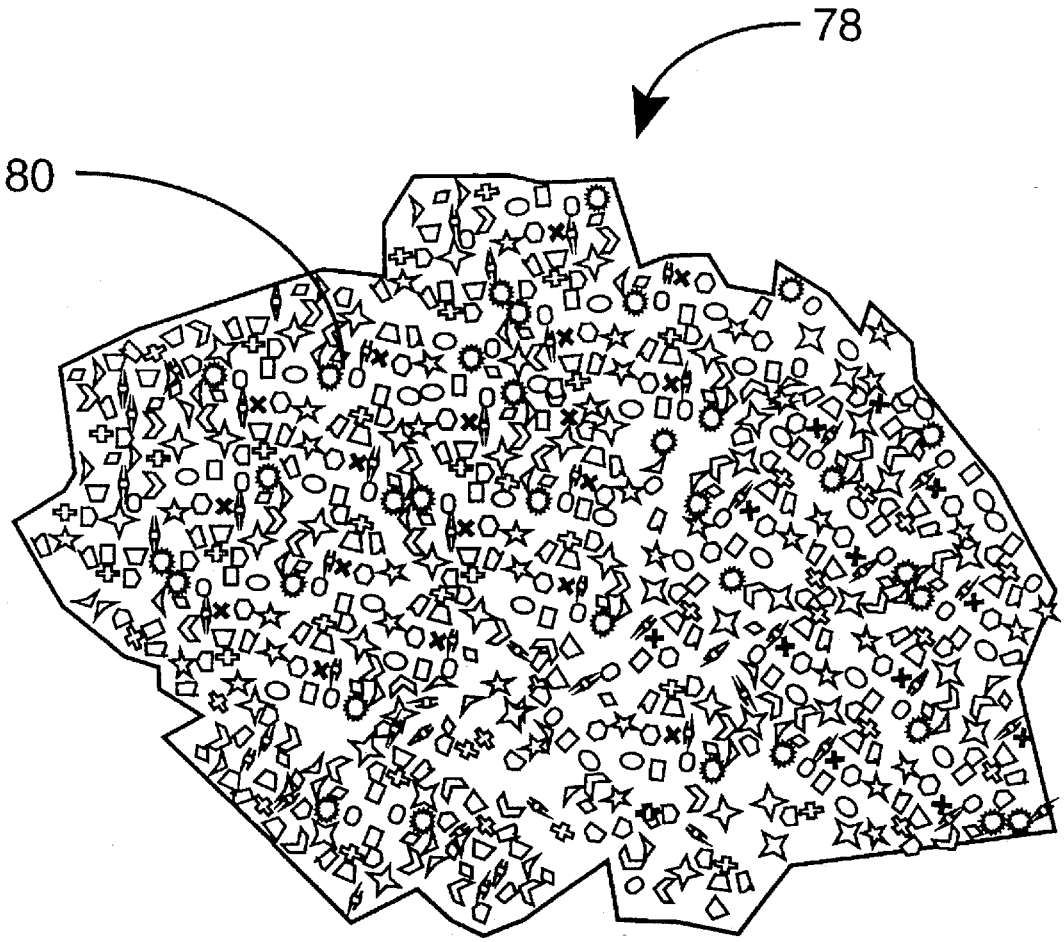
FIG. 6C is a plan view of a portion of a form according to yet another embodiment of the present invention.

FIG. 6C is a plan view of a portion of yet another form according to an embodiment of the present invention. In this embodiment openings 80 are arranged randomly in the top layer, rather than uniformly. In this embodiment there is at least one intermediate layer, and openings in the intermediate layer are also randomly arranged. An advantage is that the top and intermediate layers need not be carefully aligned to allow for printing through.

There are many alternatives whereby forms may be perforated to provide matrices of openings for through-printing, and similarly many alternatives whereby sheets may be affixed to one another to maintain alignment for printing. In the case of forms with two layers, only one of the layers having openings, there is no critical alignment. In this case the forms need not even be firmly affixed. Depending on the means by which a printer translates sheets during printing, it is perfectly conceivable that one might simply place one sheet with a matrix of openings over a sheet without openings, and feed the two at the same time through the printer without benefit of adhesive to hold the two sheets together.

In forms with sheets affixed by adhesive, it is not necessary that the adhesive cover the entire extent of a form. A spot of adhesive at each of the four corners of superimposed rectangular forms will be sufficient in many instances. In others, there may be one or more lines of adhesive.

Figure 7:
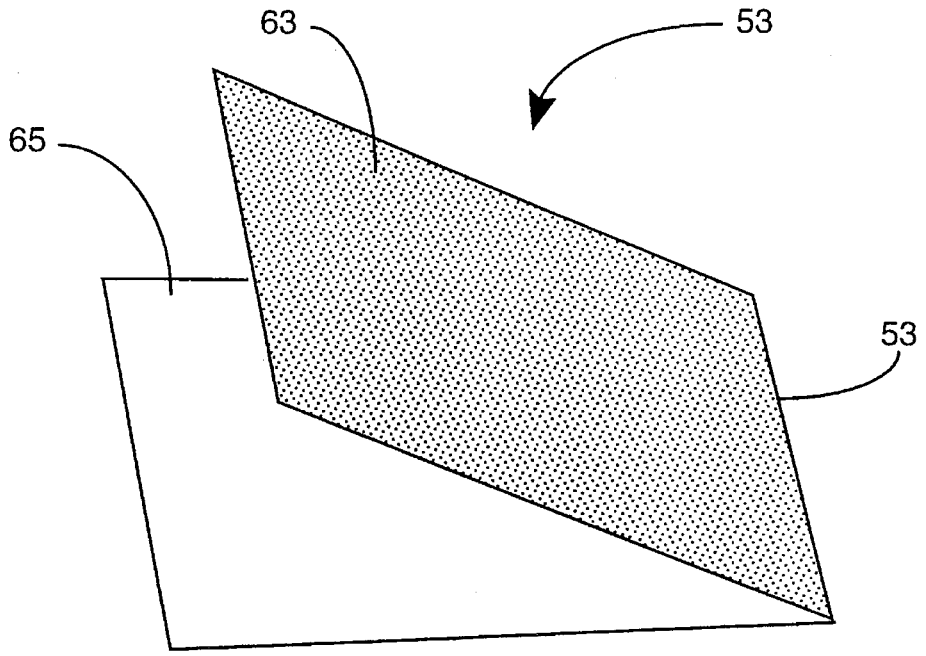
FIG. 7 is an isometric of a two layer form made by folding a single sheet with openings in one half of the sheet.

FIG. 7 illustrates yet another embodiment for a duplicating form 59 according to the invention. In this embodiment, a single sheet is folded along a line 61 to form two regions 63 and 65, one overlying the other. A hole matrix in region 63 provides for ink applied from that side to color both sheets and provide duplication.

Figure 8:
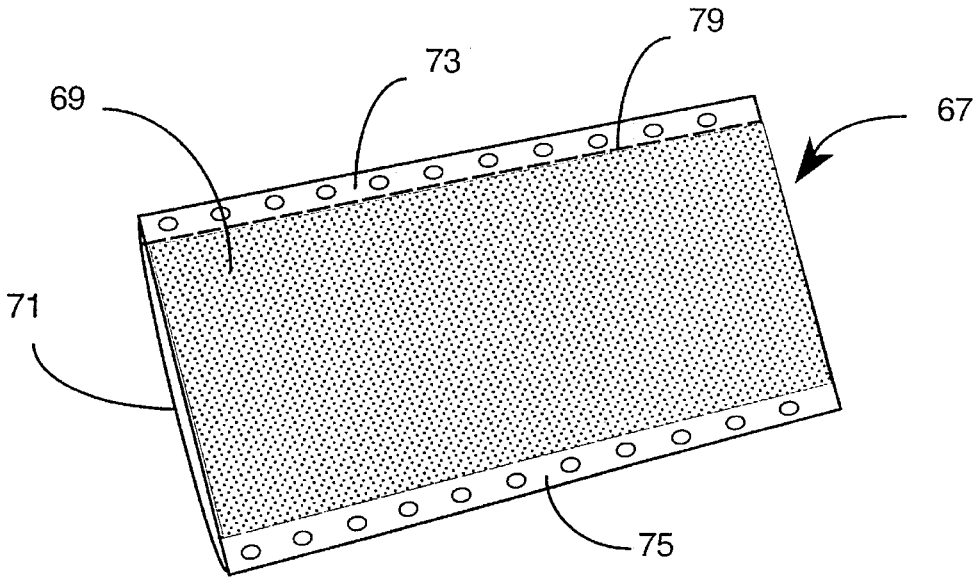
FIG. 8 is an isometric view of a form in an embodiment of the invention having separate layers adhered along opposite edges, and configured for tractor feeding.

FIG. 8 illustrates yet another embodiment wherein two sheets 69 and 71 are joined along edges 73 and 75 having perforation lines 77 and 79 just inboard from the joined edges, to provide a duplicating form 67. When the edges are removed by tearing off at the perfs, the two sheets are separated. Upper sheet 69 has openings for printing through to sheet 71, at least in regions where characters are expected to be printed. In some embodiments, print-through openings may be provided only for selected regions, while printing may be done on both the holed regions and on regions without print-through openings. In this embodiment, the edges may be provided with standard hole patterns for feeding continuous webs of such forms in edge-feeding printer types.

Figure 9:
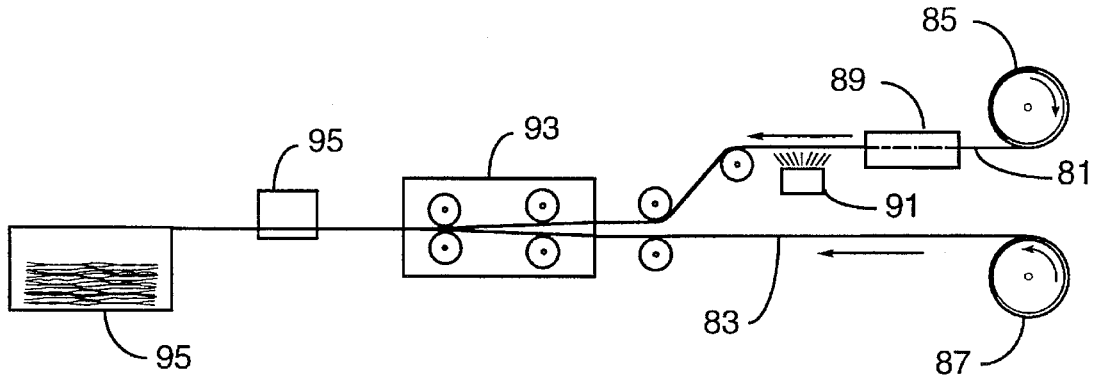
FIG. 9 is a mostly schematic illustration of a continuous process for making forms according to the invention.

There are many processes known in the art for providing suitable print-through openings in various embodiments of the invention. Openings may be provided, for example by mechanical piercing, by burning through with a tool such as a laser device, by chemical means, and in other ways. In one embodiment, illustrated schematically by FIG. 9, forms are made by a process wherein two (or more) separate webs 81 and 83 of material are drawn from rolls 85 and 87. Web 81 passes through a perforator 89, supplying a matrix of print-through openings. An adhesive is applied by spray or roller apparats (or other) at applicator 91 to at least one of the webs, on the side facing the other. The webs are brought together in a joining region 93, and cut into forms by a cross-cutting device 95 as the joined webs pass, and individual duplicating forms are collected in a bin 97.

It will be apparent to those with skill in the art that there are many other ways duplicating forms according to various embodiments of the invention might be perforated and assembled.

It is emphasized here that the duplicating forms according to embodiments of the present invention are not limited to non-impact type printers. These forms will work as well with impact printers, such as typewriters and dot-matrix devices, as well as with laser and inkjet printers and the like.

It will be apparent to those with skill in the art that there are many alterations, substitutions, and the like that may be practiced, without departing from the spirit and scope of the present invention. Many of these have been described above, such as alternative ways to perforate sheets to provide print-through openings in at least one sheet of a form according to the invention. There are similarly many joining techniques that may be used for joining sheets to make print-through forms according to the invention. Many kinds of existing apparatus may likewise be adapted to making forms that fall within the spirit and scope of the invention.

What is claimed is:

1. A method of priming two copies of a document in a single pass through a printer, comprising the steps of:

(a) making a form comprising two layers of flat printing stock, one layer having a pattern of openings exposing area on the other layer;

(b) passing the form through a printer;

(c) printing a copy of the document by applying printing ink to the side of the form having the pattern of openings, wherein some of the ink remains on said side of the form to form one copy and the remainder of the ink passes through the openings to mark the other layer; and (d) separating the two layers, providing two copies of the document printed.

2. The method of claim 1 wherein the form comprises an intermediate layer between the top layer and the base layer, the top and intermediate layer having a first pattern of openings from the top layer through to the base layer, exposing area on the base layer, and a second pattern of openings from the top layer through to the intermediate layer, exposing area on the intermediate layer, and wherein the separating step comprises separating all of the layers.

3. The method of claim 1 wherein the form comprises more than one intermediate layer, and wherein combinations of the top and intermediate layers have patterns of openings exposing area on the base layer and on each of the intermediate layers, and the separating step comprises separating all of the layers.

* * * * *